US008179214B2

(12) United States Patent
Suzuki

(10) Patent No.: US 8,179,214 B2
(45) **Date of Patent: *May 15, 2012**

(54) WAVEGUIDE CONNECTION BETWEEN A MULTILAYER WAVEGUIDE SUBSTRATE AND A METAL WAVEGUIDE SUBSTRATE INCLUDING A CHOKE STRUCTURE IN THE MULTILAYER WAVEGUIDE

(75) Inventor: Takuya Suzuki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/160,584

(22) Filed: Jun. 15, 2011

(65) Prior Publication Data

US 2011/0241805 A1 Oct. 6, 2011

Related U.S. Application Data

(63) Continuation of application No. 12/307,755, filed as application No. PCT/JP2007/071116 on Oct. 30, 2007, now Pat. No. 7,994,881.

(30) Foreign Application Priority Data

Oct. 31, 2006 (JP) ..... 2006-295688

(51) Int. Cl.
*H01P 1/04* (2006.01)

(52) U.S. Cl. ..... 333/254

(58) Field of Classification Search ..... 333/254, 333/255, 248, 246

See application file for complete search history.

(56) References Cited

U.S. PATENT DOCUMENTS

| | | | | |
|---|---|---|---|---|
| 3,155,923 | A | 11/1964 | Persson | |
| 3,214,711 | A | 10/1965 | Lyon et al. | |
| 7,994,881 | B2 * | 8/2011 | Suzuki | 333/254 |
| 2003/0042993 | A1 | 3/2003 | Sayanagi et al. | |
| 2005/0190021 | A1 | 9/2005 | Tamaki | |
| 2011/0187482 | A1 | 8/2011 | Ohno et al. | |

FOREIGN PATENT DOCUMENTS

| | | |
|---|---|---|
| JP | 11-74702 | 3/1999 |
| JP | 2001-267814 | 9/2001 |
| JP | 2002-185203 | 6/2002 |
| JP | 2003-78310 | 3/2003 |
| JP | 2003-188601 | 7/2003 |
| JP | 2005-130406 | 5/2005 |
| JP | 2006-115538 | 4/2006 |

OTHER PUBLICATIONS

Japanese Decision of a Patent Grant issued Sep. 20, 2011, in Japanese Patent Application No. 2006-295688 with English translation.

* cited by examiner

*Primary Examiner* — Benny Lee
(74) *Attorney, Agent, or Firm* — Oblon, Spivak, McClelland, Maier & Neustadt, L.L.P.

(57) ABSTRACT

A rectangular conductor pattern is formed around a first waveguide on a multilayer dielectric substrate facing a metal substrate, with an end at about λ/4 away from a long side edge of the first waveguide, where μ is a free-space wavelength of a signal wave. A conductor opening is formed between the end of the conduction pattern and the long side edge of the first waveguide, with a length longer than a long side of the first waveguide and shorter than about λ. A closed-ended dielectric transmission path is formed in the multilayer dielectric substrate in the layer direction, with a length of about λg/4, where λg is an in-substrate effective wavelength of the signal wave.

6 Claims, 5 Drawing Sheets fo: FUNDAMENTAL FREQUENCY OF HIGH-FREQUENCY SIGNAL PROPAGATED THROUGH WAVEGUIDE

CONVENTIONAL ART

CONVENTIONAL ART

WAVEGUIDE CONNECTION BETWEEN A MULTILAYER WAVEGUIDE SUBSTRATE AND A METAL WAVEGUIDE SUBSTRATE INCLUDING A CHOKE STRUCTURE IN THE MULTILAYER WAVEGUIDE

CROSS-REFERENCE TO RELATED APPLICATIONS

This application is a continuation of U.S. Ser. No. 12/307,755 filed Jan. 7, 2009, which issued as U.S. Pat. No. 7,994,881 on Aug. 9, 2011, the entire content of which is incorporated herein by reference. U.S. Ser. No. 12/307,755 (now U.S. Pat. No. 7,994,881) is a National Stage of PCT/JP07/071116 filed Oct. 30, 2007, which also claims priority under 35 U.S.C. 119 to Japanese Application No. 2006-295688 filed Oct. 31, 2006.

TECHNICAL FIELD

The present invention relates to a waveguide connection structure for connecting a hollow waveguide formed in a multilayer dielectric substrate in its layer direction and a waveguide formed in a metal substrate.

CONVENTIONAL ART

In a conventional waveguide connection structure by which a waveguide (through hole) arranged in an organic dielectric substrate (connecting member) to transmit an electromagnetic wave is connected to a waveguide arranged in a metal waveguide substrate, a conductor on the through hole and the metal waveguide substrate are electrically connected to each other and are maintained at the same electric potential, so that reflection, transmission loss, and leakage of the electromagnetic wave are prevented at a connection area of the waveguides (for example, see Patent document 1).

In the conventional waveguide connection structure disclosed in Patent document 1, a gap is formed between a conductor layer on the through hole and the waveguide substrate due to warpage, or the like, of the organic dielectric substrate. As a result, there is a problem that a leaky wave in a parallel plate mode occurs between metal conductors and the reflection and the transmission loss of the electromagnetic wave becomes large at the connection area.

To improve the above-described degradation of the connection characteristics, a conventional choke structure is often employed in which a groove having a depth of $\lambda/4$ is formed at a position $\lambda/4$ away from an E-plane edge of the waveguide, and the E-plane edge of the waveguide is closed-ended in a standing wave from a closed-end point of a choke groove (for example, see Patent document 2).

Patent document 1: Japanese Patent Application Laid-open No. 2001-267814 (paragraph [0028], FIG. 1) Patent document 2: U.S. Pat. No. 3,155,923

SUMMARY OF THE INVENTION

Problem To Be Solved By the Invention

However, in the conventional choke structure described in Patent document 2, when the connected waveguides are misaligned with respect to each other, there is a problem that resonance in a higher order mode occurs and the connection characteristics are degraded around a signal band corresponding to a dimension of a choke.

The present invention has been made to solve the above problems in the conventional technology and it is an object of the present invention to provide a waveguide connection structure by which, even when the gap is formed between a multilayer dielectric substrate and a metal substrate due to warpage, or the like, of the multilayer dielectric substrate and the metal substrate, it is possible to achieve the connection characteristics of the waveguides with lower leakage and lower loss of signals at the connection area of the waveguides, and to prevent the degradation of the connection characteristics that occurs due to the resonance in the higher order mode when the waveguides are misaligned.

Means For Solving The Problem

To solve the above problems and to achieve the object, the present invention is featured in a waveguide connection structure for connecting a first waveguide formed as a hollow opening in a multilayer dielectric substrate in its layer direction and a second waveguide formed on a metal substrate, that the waveguide connection structure includes a choke structure including a rectangular conductor pattern formed around the first waveguide on a dielectric surface of the multilayer dielectric substrate facing the metal substrate, having an end at a position about $\lambda/4$ ($\lambda$: a free-space wavelength of a signal wave) away from an E-plane edge of the first waveguide, a conductor opening formed at a predetermined position on the conductor pattern between the end of the conduction pattern and the E-plane edge of the first waveguide, having a length longer than a long side of the first waveguide and shorter than about $\lambda$, and a closed-ended dielectric transmission path connected to the conductor opening and formed in the multilayer dielectric substrate in the layer direction, having a length of about $\lambda g/4$ ($\lambda g$: an in-substrate effective wavelength of the signal wave). The metal substrate referred in the present invention includes, as well as a metal substrate consisting entirely of metal, a conductive substrate formed by coating a metal film on a partial surface (for example, a surface of the waveguide and a circumferential surface of the waveguide connecting portion) or the whole surface of a non-metal substrate such as a ceramic substrate and an organic substrate and a functional parts in the form of plates with a plurality of substrates integrally bonded to form a feeder circuit or an RF (Radio Frequency) circuit of a slot antenna and the like (for example, waveguide plate, planar antenna, power divider/combiner, and the like).

Effect of the Invention

According to the present invention, it is configured such that the E-plane edge of the waveguide is closed-ended by suppressing the parallel plate mode between the multilayer dielectric substrate and the metal substrate by a magnetic wall (open-ended in a standing wave) formed on an end of a conductor pattern in addition to the choke structure. Thus, it is possible to achieve the connection characteristics of the waveguides with lower leakage and lower loss of signals at the connection area of the waveguides, and to prevent the degradation of the connection characteristics that occurs in conventional technology due to the resonance in the higher order mode when the waveguides are misaligned. Furthermore, better connection characteristics can be achieved regardless of whether waveguides parts are in a contact state or a non-contact state. Moreover, compared with a choke structure that needs to have a relatively large size for a high-frequency band, such as a millimeter waveband, it is possible to reduce a size and a weight of the choke structure, and it is not necessary to perform a mechanical processing on the choke groove formed on the metal waveguide with a high accuracy as performed in the conventional technology.

EXPLANATIONS OF LETTERS OR NUMERALS

Figure 1:
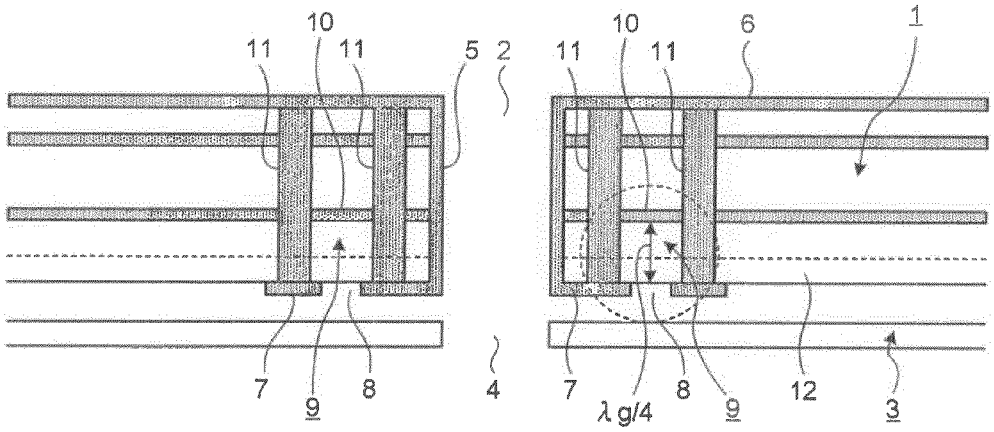
FIG. 1 is a cross section of a waveguide connection structure according to an embodiment of the present invention.

1 multilayer dielectric substrate
2 waveguide
3 metal substrate
4 waveguide
5 conductor layer
6 surface-layer ground conductor
7 conductor pattern (land portion)
8 opening
9 closed-ended dielectric waveguide (dielectric transmission path)
10 inner-layer ground conductor
11 ground via
12 dielectric

BEST MODE(S) FOR CARRYING OUT THE INVENTION

Exemplary embodiments of the present invention are explained in detail below with reference to the accompanying drawings, wherein like features in the different figures are denoted by the same reference number and may not be described in detail in all drawing figures in which they appear. The present invention is not limited to the embodiments.

Figure 2:
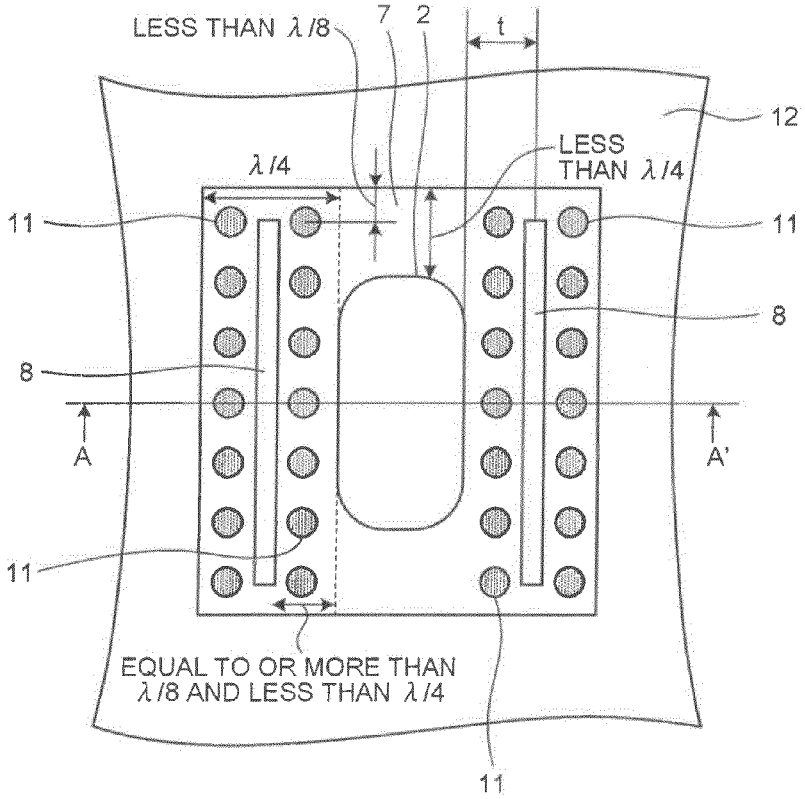
FIG. 2 is a plan view for explaining the configuration of a land according to the embodiment.

The embodiment of the present invention will be described below with reference to FIGS. 1 and 2. FIG. 1 is a cross section of a waveguide connection structure according to the embodiment. FIG. 2 is a plan view of a conductor pattern portion (land portion). The cross section shown in FIG. 1 corresponds to a cross section taken along a line A-A' in FIG. 2. The waveguide connection structure according to the embodiment is applied to, for example, a millimeter-wave or microwave radar, such as an FM/CW radar.

A hollow waveguide 2 having a substantially rectangular shape at cross section is formed in a multilayer dielectric substrate 1 (FIG. 1) in its layer direction, and a hollow waveguide 4 (FIG. 1) having a substantially rectangular shape at cross section is formed in a metal substrate 3 (FIG. 1) such that the waveguide 4 faces the waveguide 2 (an opening of the waveguide 2). The metal substrate (conductive substrate) 3 can be formed by one substrate, or by integrally joining one or more metal substrates (conductive substrates).

An electromagnetic wave input from a surface layer of the multilayer dielectric substrate 1 or from a surface layer (the lower side in FIG. 1) of the metal substrate 3 is transmitted by the waveguides 2 and 4. Although it is shown in FIG. 1 that the multilayer dielectric substrate 1 and the metal substrate 3 are spaced apart from each other, the multilayer dielectric substrate 1 is positioned on the metal substrate 3 by positioning pins (not shown) at two points, and is attached to the metal substrate 3 in an abutting manner with a screw (not shown). Thus, the multilayer dielectric substrate 1 and the metal substrate 3 are fixed to each other such that a center axis of the waveguide 2 in the multilayer dielectric substrate 1 matches a center axis of an opening of the waveguide 4 in the metal substrate 3. The multilayer dielectric substrate 1 and the metal substrate 3 are firmly attached to each other by a fastening force of the screw. The openings of the waveguide 2 and the waveguide 4 have substantially the same size. The positioning pins are arranged such that the misalignment between the waveguide 2 and the waveguide 4 is less than 0.2 mm, for example, about 0.1 mm.

A conductor layer 5 (FIG. 1) is formed on an inner circumferential wall of the waveguide 2. The conductor layer 5 is connected to a surface-layer ground conductor 6 (FIG. 1) formed on a front side of the multilayer dielectric substrate 1 and a conductor pattern portion (land portion) 7 (FIG. 1) formed on a back side (waveguide connection end side to be in contact with the metal substrate 3) of the multilayer dielectric substrate 1. The surface-layer ground conductor 6 is constructed of a conductor pattern.

As shown in FIG. 2, the rectangular land portion 7, which is a conductor layer formed on the side of the multilayer dielectric substrate 1 facing the metal substrate 3, surrounds the waveguide 2 (the opening of the waveguide 2). A dielectric 12 of the multilayer dielectric substrate 1 is exposed around the land portion. A surface of the exposed portion of the dielectric 12 can be coated with glass or solder resist. Furthermore, a conductor pattern can be formed around the land portion 7 such that the conductor pattern is not connected to the land portion 7 and spaced apart from the land portion 7 with a predetermined distance (a distance such that the conductor pattern is not coupled to the land portion 7 in a high frequency wave, for example a distance larger than $\lambda/4$), and can be connected to an inner layer circuit in the multilayer dielectric substrate 1 and a mounted electric component or an external electric circuit.

When a free-space wavelength of a high-frequency signal transmitted in the waveguide 2 is $\lambda$ and an effective wavelength of the high-frequency signal in the dielectric, i.e., an in-substrate effective wavelength is $\lambda g$, the rectangular land portion 7 has a dimension such that an end of the pattern is positioned at about $\lambda/4$ from an E-plane edge (an edge of a long side) of the waveguide 2 and at less than about $\lambda/4$ from an H-plane edge (an edge of a short side) of the waveguide 2 (less than about $\lambda/8$ from the H-plane edge of the opening 8).

Conductor openings 8 through which the dielectric is exposed are formed on both sides of the waveguide 2 with a predetermined distance t from the E-plane edge of the waveguide 2 (the E-plane edge of the opening of the waveguide 2) on the rectangular land portion 7. The distance t from the E-plane edge of the waveguide to the opening 8 is set within a range from equal to or more than about $\lambda/8$ and less than $\lambda/4$, that is shorter than $\lambda/4$ which corresponds to a dimension of a choke in a signal frequency, and preferably, for example, about λ/6 in consideration of a manufacturing error and a dimension tolerance. A width of the opening 8 is preferably smaller than λg/4, and a length of the opening 8 is preferably longer than the length of the waveguide 2 in the longitudinal direction and shorter than about λ.

The opening 8 is connected to a closed-ended dielectric waveguide 9 (FIG. 1) having a length of about λg/4 (FIG. 1) in the layer direction of the multilayer dielectric substrate 1. The closed-ended dielectric waveguide 9 includes inside the multilayer dielectric substrate 1 an inner-layer ground conductor 10 (FIG. 1), a plurality of ground vias (ground through holes) 11, and the dielectric. The inner-layer ground conductor 10 is located in a depth of about λg/4 in the layer direction from a position where the opening 8 is formed. The ground vias 11 are arranged around the opening 8. The dielectric is arranged inside the inner-layer ground conductor 10 and the ground vias 11. The closed-ended dielectric waveguide 9 functions as a dielectric transmission path having a closed-end surface on its end (a conductor surface of the inner-layer ground conductor 10). An interval between the ground vias 11 is set to equal to or less than λg/4.

As described above, in the embodiment, a choke structure is formed by the land portion 7, the opening 8, and the closed-ended dielectric waveguide 9.

A case will be considered below where the multilayer dielectric substrate 1 and the metal substrate 3 are not in contact with each other because the multilayer dielectric substrate 1 and the metal substrate 3 are spaced apart from each other, resulting in a gap between the multilayer dielectric substrate 1 and the metal substrate 3 at a waveguide connection area. In the choke structure, an end of the closed-ended dielectric waveguide 9 is closed-ended, and the opening 8, located λg/4 away from the end of the closed-ended dielectric waveguide 9, is open-ended. Moreover, because the opening 8 is located equal to or more than about λ/8 and less than λ/4 away from the E-plane edge of the waveguide 2, the E-plane edge of the waveguide 2 is in a state of turning from the open to the close. Therefore, the E-plane edge of the waveguide 2 is closed-ended in an ideal manner in a frequency slightly higher than a signal frequency. Furthermore, in the choke structure according to the embodiment, because the end of the land portion 7 forms a magnetic wall for a waveguide formed by the gap between the waveguides and is open-ended in a standing wave, the E-plane edge of the waveguide, located λ/4 away from the end of the land portion, is closed-ended in a signal frequency band. As described above, in the choke structure according to the embodiment, it is possible to achieve better connection characteristics in a frequency band slightly higher than the signal band.

Furthermore, in the choke structure according to the embodiment, a choke groove is formed by the opening 8 and the closed-ended dielectric waveguide 9 at a position equal to or more than about λ/8 and less than λ/4 away from the E-plane edge of the waveguide 2, rather than a position λ/4 away from the E-plane edge of the waveguide like a conventional choke groove. Therefore, when the waveguides are misaligned, although resonance occurs in a band slightly higher than the signal band, there is no characteristic degradation due to the resonance near the signal band, so that it is possible to achieve better connection characteristics.

Moreover, in the choke structure according to the embodiment, when only the end of the land portion 7 is in contact with the metal substrate 3, the best characteristics can be achieved in a band higher than the signal band due to the effect of the choke groove, and better characteristics can be generally achieved near the signal band due to the effect of the choke groove. When the metal substrate 3 and the land portion 7 are in contact with each other and the conductor opening 8 is closed, the metal substrate 3 and the land portion 7 are physically in contact with each other at a position about λ/8 from the E-plane edge of the waveguide and are maintained at the same electric potential, so that better characteristics can be generally achieved.

Figure 3:
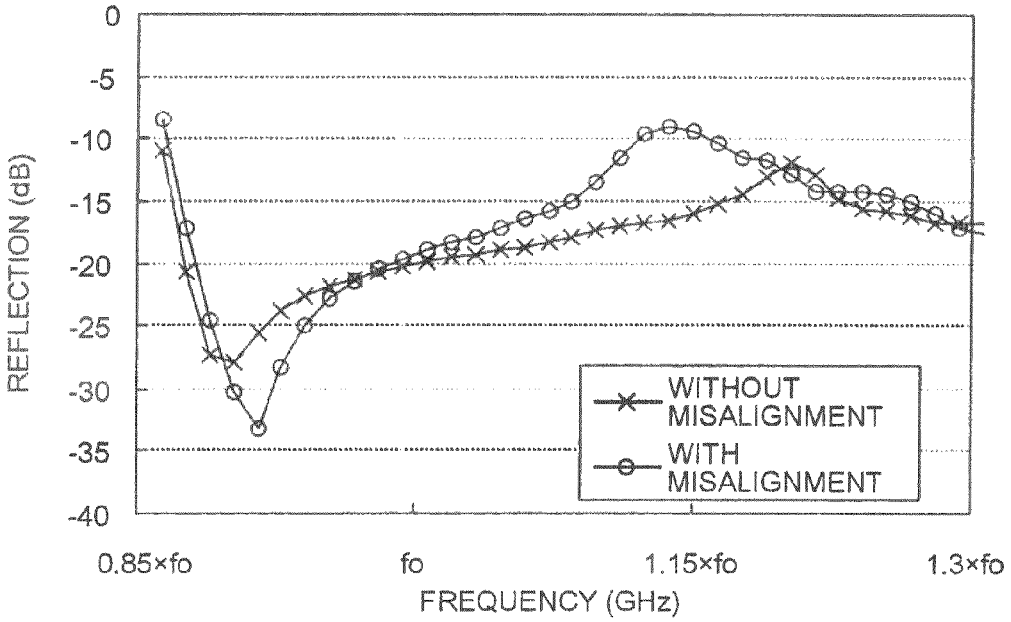
FIG. 3 is a diagram for explaining reflection characteristics when simulation is carried out by using a choke structure according to the embodiment.
Figure 4:
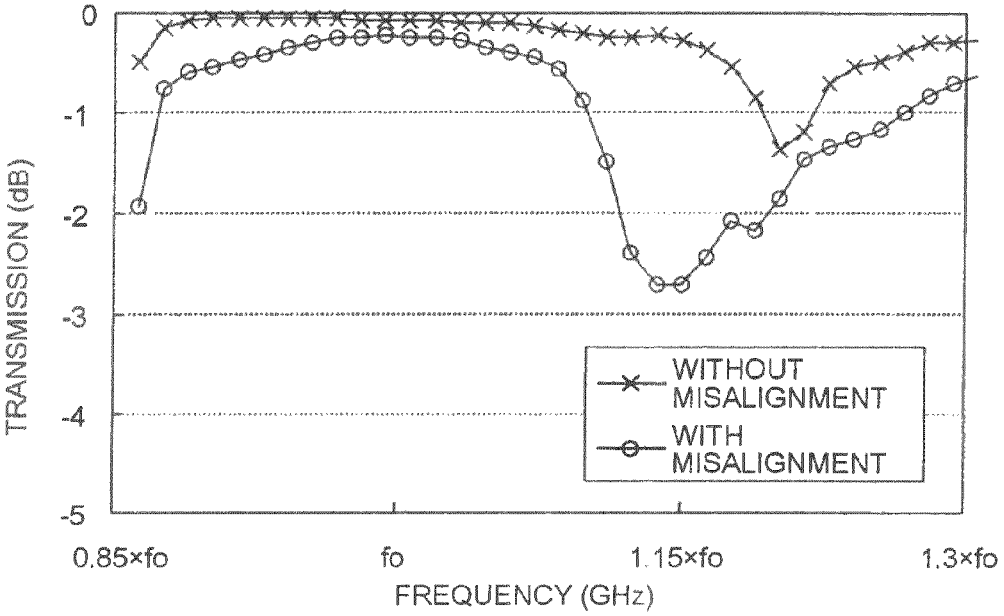
FIG. 4 is a diagram for explaining transmission characteristics when simulation is carried out by using the choke structure according to the embodiment.

FIG. 3 illustrates representative reflection characteristics in dB vs. frequency in GHz of the choke structure according to the embodiment, and FIG. 4 illustrates representative transmission characteristics in dB vs. frequency in GHz of the choke structure. In FIGS. 3 and 4, the characteristics in dB vs. frequency in GHz when there is no misalignment between the two waveguides are indicated by crosses, and the characteristics when there is misalignment between the two waveguides are indicated by circles. As shown in FIGS. 3 and 4, in the choke structure according to the embodiment, when the waveguides are misaligned, the resonance in the higher order mode causes the degradation of the reflection characteristics and the transmission characteristics in a band slightly higher than a signal band near a basic frequency f0 of a millimeter-waveband high-frequency signal which is transmitted in the waveguide. However, because there is no characteristic degradation due to the resonance near the signal band, better reflection and transmission characteristics can be achieved.

Next, the conventional choke structure as described in Patent document 2 will be examined as a comparative example. In this type of choke structure, a choke groove having a depth of about λ/4 is formed on a contact surface of one of two waveguide carriers having opposing waveguides formed therein at a position about λ/4 away from a long side edge of the waveguide and extremely near a short side edge of the waveguide. Patent document 2 describes a rectangular choke groove surrounding the waveguide. Moreover, as a different conventional example, a circular choke groove having a depth of about λ/4 is formed around the waveguide at a position λ/4 away from a long side edge of the waveguide.

With the above waveguide choke structure, the long side edge of the waveguide is closed-ended in a standing wave in the signal frequency band, so that a leaky wave from a gap between the two waveguide carriers can be prevented, and better reflection characteristics and transmission characteristics can be achieved.

Figure 5:
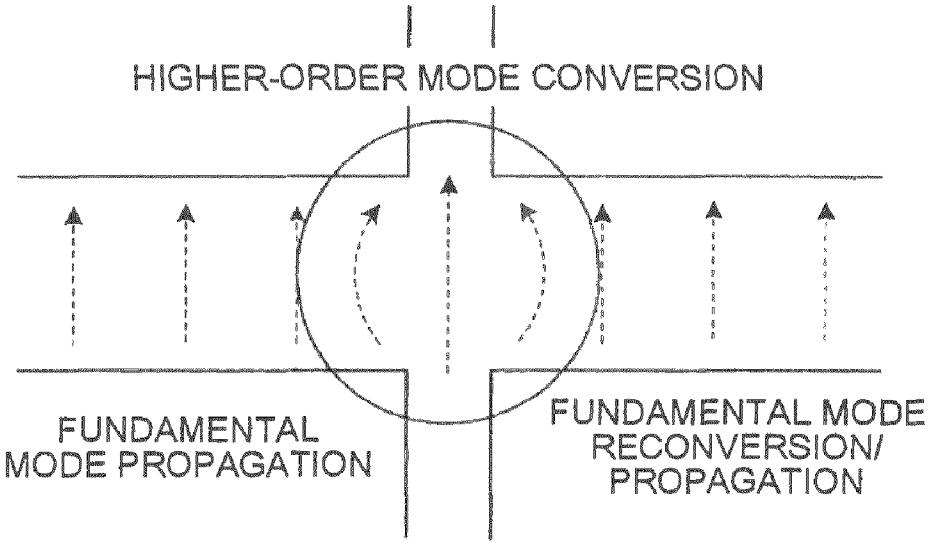
FIG. 5 is a diagram for explaining a higher-order mode conversion at a discontinuous area in a transmission line.

However, the above choke effect can be achieved only when there is no misalignment between the two opposing waveguides in an ideal manner. Generally, as shown in FIG. 5, in a transmission line having a discontinuous area, a signal transmitted in a basic or fundamental mode is converted into a plurality of higher order modes at the discontinuous area, and is then reconverted into the basic or fundamental mode and transmitted in the basic mode. At this time, if signals do not lose power when the signals are converted into the higher order modes at the discontinuous area (gap), most of the signals are reconverted into the basic or fundamental mode, and transmitted again in the transmission line. However, if the signals lose power at the discontinuous area, the signals reconverted into the basic or fundamental mode are degraded corresponding to the power loss in the higher order modes, resulting in the degradation of the transmission characteristics. When the two opposing waveguides are misaligned, an asymmetric electromagnetic field mode occurs at the discontinuous area in the transmission line due to the misalignment of the waveguides, and the resonance in the higher order mode occurs in a frequency band that is almost double the signal band corresponding to the dimension of the choke.

Therefore, the power is lost just near the signal band, resulting in rapid degradation of reflection, transmission, and isolation characteristics.

Figure 6:
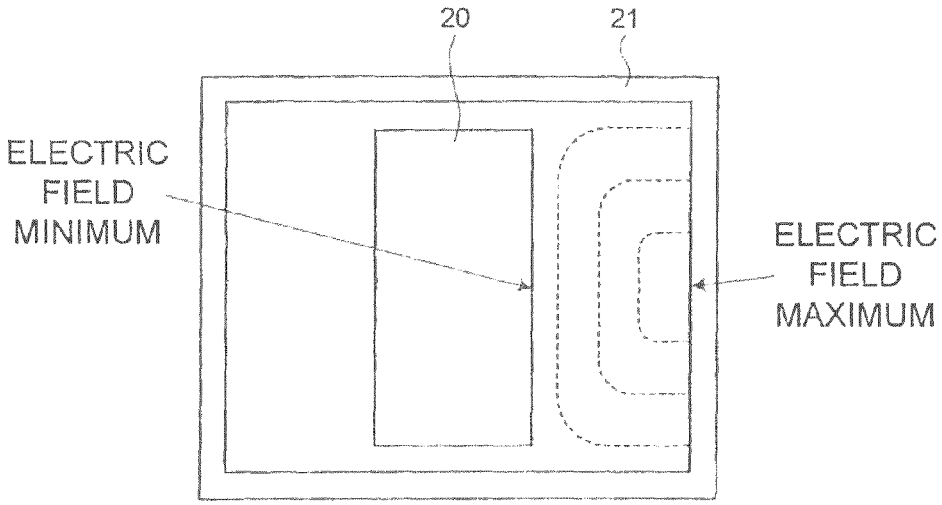
FIG. 6 is a plan view of a conventional choke structure.
Figure 7:
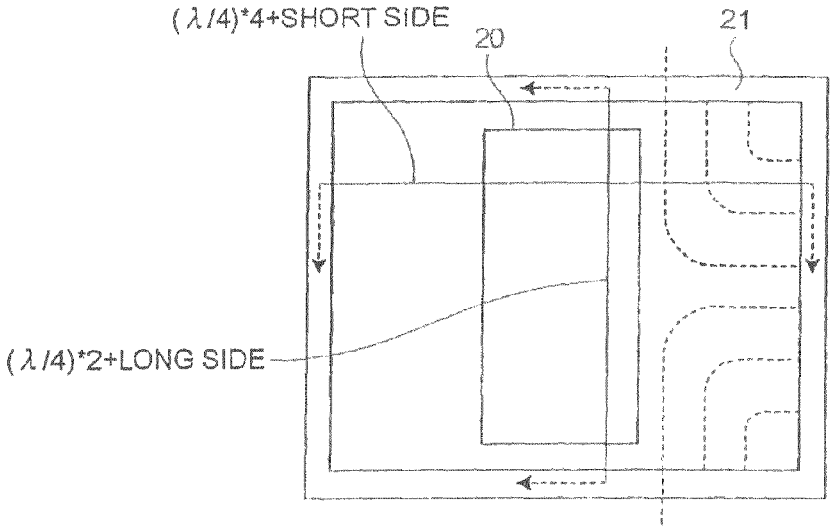
CONVENTIONAL ART FIG.7
FIG. 7 is a plan view for explaining resonance in a higher order mode in the conventional choke structure.

Specifically, FIGS. 6 and 7 illustrate a conventional choke structure in which a choke groove 21 having a depth of about λ/4 is formed around a waveguide 20 at a position about λ/4 away from a long side edge of the waveguide 20 and extremely near a short side edge of the waveguide 20. For the basic mode, a choke is operated such that standing waves are generated only on the long side of the waveguide 20, and the long side edge of the waveguide is virtually closed-ended (see FIG. 6). However, at the same time, for a double frequency band, because a size of a waveguide in a gap area including the choke is larger than that of the waveguide, when a discontinuous area is formed, a signal is transmitted in the higher order mode. In the case of the conventional choke groove having the length of λ/4 with respect to the signal frequency as described in Patent document 2, because the standing waves are generated due to the closed end (electric wall) by the choke on both the long side and the short side of the waveguide, the resonance in the higher order mode occurs (see FIG. 7). As shown in FIG. 7, because the size of the waveguide in the gap area is equal to or more than 5λ/4 between the chokes on the long sides and equal to or more than λ between the chokes on the short sides, the resonance occurs in a higher order mode than TE20. Thus, the transmission characteristics in the basic mode is degraded corresponding to the power loss (thermal diffusion, leakage to an adjacent waveguide) due to the resonance in the higher order mode.

As described above, in the conventional choke structure as described in Patent document 2, because a distance between the ends (closed-end points) of the choke groove on each of the long sides and the short sides is in the range from λ to 5λ/4 near a design frequency band of the choke, there occurs the resonance corresponding to a double wave in the signal band. Therefore, the resonance in TE202 mode inevitably occurs extremely near the signal band, and the reflection and the power loss occur.

FIG. 6 shows positions at which the electric field is a maximum and the electric field is a minimum, labeled as Minimum Electric Field and Maximum Electric Field.

As shown in FIG. 7, the lengths between ends of each choke groove are (λ/4)*4+ SHORT SIDE and (λ/4)*2+ LONG SIDE.

Figure 8:
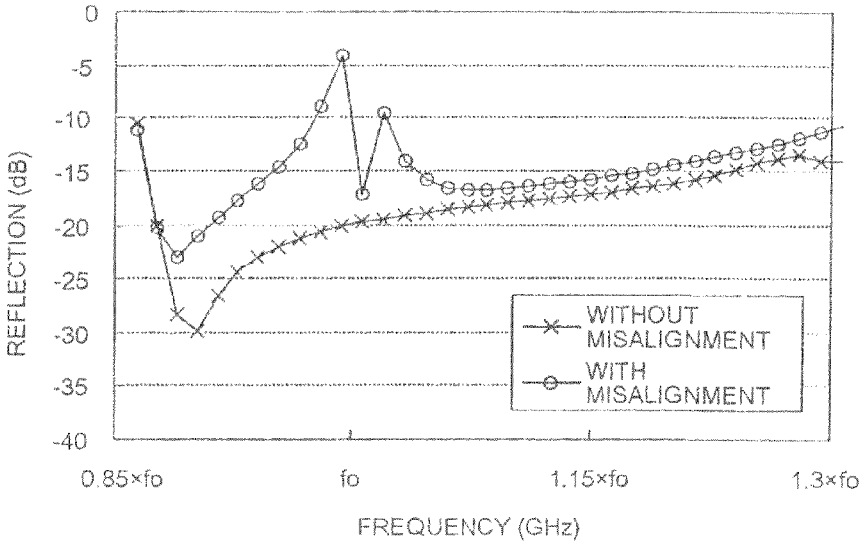
FIG. 8 is a diagram for explaining reflection characteristics when simulation is carried out by using the conventional choke structure.
Figure 9:
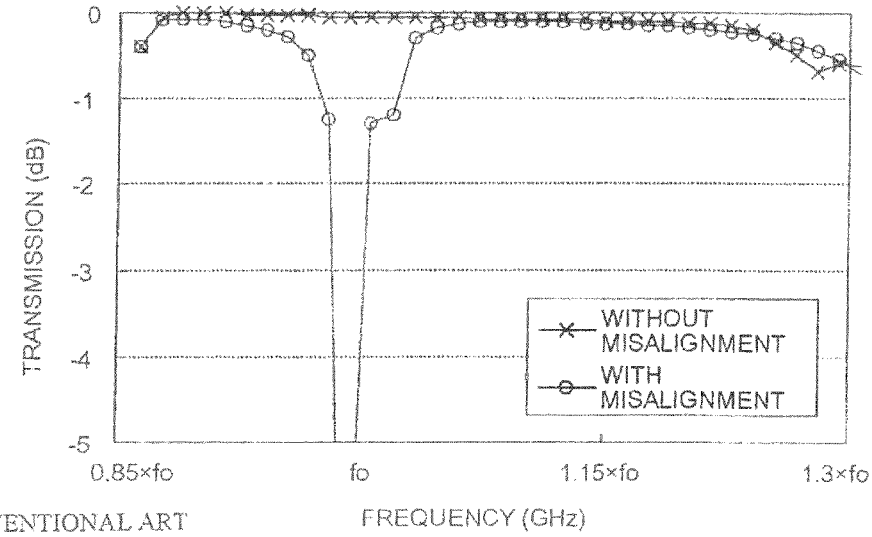
CONVENTIONAL ART FIG.9
FIG. 9 is a diagram for explaining transmission characteristics when simulation is carried out by using the conventional choke structure.

FIGS. 8 and 9 illustrate representative reflection characteristics and transmission characteristics of the conventional choke structure. The characteristics in dB vs. frequency in GHz when there is no misalignment between the two waveguides are indicated by crosses, and the characteristics when there is misalignment between the two waveguides are indicated by circles. As shown in FIGS. 8 and 9, when the waveguides are misaligned, the resonance in the higher order mode causes the rapid degradation of the transmission characteristics and the reflection characteristics near the signal band around the frequency $f_0$.

To achieve enough electric characteristics with the choke structure described in Patent document 2, high surface roughness and flatness of a contact surface is required, and mechanical processing with an extremely high accuracy is necessary, resulting in expensive costs of processing. Especially, although a waveguide is used for a millimeter waveband (30 GHz to 300 GHz) to reduce the transmission loss in the transmission line, the choke structure has a size of about several millimeters, which is a limit value for performing the mechanical processing, to reduce a size of a circuit, and therefore a higher processing accuracy is required.

As described above, compared with the conventional choke structure described in Patent document 2, the choke structure according to the embodiment makes it possible to achieve better connection characteristics regardless of the misalignment of the waveguides or whether waveguides parts are in a contact state or a non-contact state.

As described above, in the embodiment, the parallel plate mode between the multilayer dielectric substrate and the metal substrate is suppressed by the magnetic wall formed on the end of the land portion 7 in addition to the effect of the choke, and the E-plane edge of the waveguide is closed-ended in the frequency band extremely near the signal band. Thus, it is possible to achieve the connection characteristics of the waveguides with lower leakage and lower loss of signals at the connection area of the waveguides, and to prevent the degradation of the connection characteristics that occurs due to the resonance in the higher order mode when the waveguides are misaligned in the conventional technology. Furthermore, it is possible to achieve better connection characteristics regardless of whether the waveguide parts are in a contact state or a non-contact state. Moreover, compared with the choke structure that needs to have a relatively large size for a high-frequency band, such as a millimeter waveband, it is possible to reduce the size and the weight of the choke structure, and it is not necessary to perform the mechanical processing on the choke groove formed on the metal waveguide, or the like, with the high accuracy as performed in the conventional technology.

Industrial Applicability

As described above, the waveguide connection structure according to the present invention is useful for connecting a dielectric substrate having a waveguide formed therein and a metal substrate having a waveguide formed therein to transmit the electromagnetic wave.

The invention claimed is:

1. A waveguide connection structure for connecting a first waveguide formed as a hollow opening in a multilayer dielectric substrate in a layering direction thereof and a second waveguide disposed on a substrate, the waveguide connection structure comprising:

a choke structure that includes, a rectangular conductor pattern disposed around the first waveguide on a dielectric surface of the multilayer dielectric substrate facing the substrate, having an end at a position about λ/4 away from a long side edge of the first waveguide, where λ is a free-space wavelength of a signal wave, a conductor opening disposed at a predetermined position on the rectangular conductor pattern between the end of the rectangular conductor pattern and the long side edge of the first waveguide, having a length longer than a long side of the first waveguide and shorter than about λ and a width less than λg/4, in which λg is an in-substrate effective wavelength of the signal wave, and a closed-ended dielectric transmission path connected to the conductor opening and disposed in the multilayer dielectric substrate in the layering direction, having a length of about λg/4.

2. The waveguide connection structure according to claim 1, wherein the conductor opening is disposed at a position equal to or more than about λ/8 and less than λ/4 away from the long side edge of the first waveguide.

3. The waveguide connection structure according to claim 1, wherein a pattern end of the rectangular conductor pattern is provided on a short side of the first waveguide and is located at a position less than about λ/4 away from a short side edge of the first waveguide.

4. The waveguide connection structure according to claim 1, wherein the closed-ended dielectric transmission path includes an inner-layer ground conductor, a plurality of ground through holes, and a dielectric arranged inside the inner-layer ground conductor and the ground through holes.

5. A waveguide connection structure for connecting a first waveguide formed as a hollow opening in a multilayer dielectric substrate in a layering direction thereof and a second waveguide disposed on a substrate, the waveguide connection structure comprising:

a choke structure that includes:

a rectangular conductor pattern disposed around the first waveguide on a dielectric surface of the multilayer dielectric substrate facing the substrate, having an end at a position about λ/4 away from a long side edge of the first waveguide, where λ is a free-space wavelength of a signal wave;

a conductor opening disposed at a predetermined position, equal to or more than λ/8 and less than λ/4 away from the long side edge of the first waveguide, on the rectangular conductor pattern between the end of the rectangular conductor pattern and the long side edge of the first waveguide, having a length longer than a long side of the first waveguide and shorter than about λ; and a closed-ended dielectric transmission path connected to the conductor opening and disposed in the multilayer dielectric substrate in the layering direction, having a length of about λg/4, where λg is an in-substrate effective wavelength of the signal wave.

6. A waveguide connection structure for connecting a first waveguide formed as a hollow opening in a multilayer dielectric substrate in a layering direction thereof and a second waveguide disposed on a substrate, the waveguide connection structure comprising:

a choke structure that includes:

a rectangular conductor pattern disposed around the first waveguide on a dielectric surface of the multilayer dielectric substrate facing the substrate, having an end at a position about λ/4 away from a long side edge of the first waveguide, where λ is a free-space wavelength of a signal wave, a pattern end of the rectangular conductor pattern is provided on a short side of the first waveguide and is located at a position less than about λ/4 away from a short side edge of the first waveguide;

a conductor opening disposed at a predetermined position on the rectangular conductor pattern between the end of the rectangular conductor pattern and the long side edge of the first waveguide, having a length longer than a long side of the first waveguide and shorter than about λ; and a closed-ended dielectric transmission path connected to the conductor opening and disposed in the multilayer dielectric substrate in the layering direction, having a length of about λg/4, where λg is an in-substrate effective wavelength of the signal wave.

* * * * *